US005950946A

United States Patent [19]

Kjellqvist et al.

[11] Patent Number: 5,950,946

[45] Date of Patent: Sep. 14, 1999

[54] PAIR OF CO-OPERATING REFINING ELEMENTS INTENDED FOR A DISC REFINER

[75] Inventors: OLof Kjellqvist, Sundsvall; Christer Nästrén, Upplands Väsby, both of Sweden

[73] Assignee: Sunds Defibrator Industries AB, Sweden

[21] Appl. No.: 09/051,873

[22] PCT Filed: Oct. 9, 1996

[86] PCT No.: PCT/SE96/01274

§ 371 Date: Apr. 22, 1998

§ 102(e) Date: Apr. 22, 1998

[87] PCT Pub. No.: WO97/18037

PCT Pub. Date: May 22, 1997

[30] Foreign Application Priority Data

Nov. 13, 1995 [SE] Sweden ..... 9504023

[51] Int. Cl.[6] ..... B02C 7/12

[52] U.S. Cl. ..... 241/261.2; 241/296

[58] Field of Search ..... 241/261.2, 261.3, 241/296, 297, 298

[56] References Cited

U.S. PATENT DOCUMENTS 4,253,613 3/1981 Reinhall ..... 241/261.2

FOREIGN PATENT DOCUMENTS 2 083 375 3/1982 United Kingdom .

*Primary Examiner*—Mark Rosenbaum

*Attorney, Agent, or Firm*—Lerner, David, Littenberg, Krumholz & Mentlik, LLP

[57] ABSTRACT

Apparatus for refining lignocellulose material is disclosed including two relatively rotatable refining disks separated by a refining gap which includes an inner radial portion and an outer angular portion, with the refiner elements mounted on the outer angular portions of the refiner disks including at least one wing projecting from the rotatable refining disk adjacent to the inner radial refining gap and with the stationary refining disk including a concave surface at the inlet portion so that the lignocellulose material being processed is thrown against the concave surface during its transition from the inner radial refining gap to the outer angular refining gap.

4 Claims, 2 Drawing Sheets

PAIR OF CO-OPERATING REFINING ELEMENTS INTENDED FOR A DISC REFINER

FIELD OF THE INVENTION

The present invention relates to refining elements for use in refiners of the disk type for lump-shaped, preferably lignocellulosic material, which refiner includes relatively rotatable refining elements, which form a refiner gap therebetween. The present invention further relates to such refining elements in which the outer portion of the refiner gap, spaced from the center of rotation, is angular in relation to the radial plane, so that it extends to a substantial degree in the axial direction.

BACKGROUND OF THE INVENTION

A particularly important field of application for the present invention is in connection with refiners for making fiber- or papermaking pulp from wood chips or similar cellulosic material. Refiners of the disk type are formed with a refiner gap extending in the radial direction between the refining elements, which gap starts from a central feed zone for the raw material where the centrifugal force is relatively low. The centrifugal force affecting the material to be refined therein increases very strongly with increasing radius. In order to prolong the dwell time in the outer portion of the refiner gap, the outer portion thereof can be formed so as to extend angularly in relation to the radial direction, so that only part of the centrifugal force is permitted to affect the material to be refined in the flow direction of the refiner gap. While steps have thus been taken in order to limit the flow rate of the material to be refined in the radially or outer portion of the refiner gap in connection with this design the effect of the centrifugal force in the central feed zone is low, so that the feed to the outer angular portion of the refiner gap is not as intense as would be desired in order to achieve the maximum capacity of the refiner. Attempts have been made to introduce mechanical devices to promote the discharge in the central feed zone, which, however, are not effective, because, inter alia, they must be exchanged relatively often due to their rapid wear.

An object of the present invention is to eliminate these problems and thereby bring about effective feed of the material to be refined from the inner radial portion of the refining zone to the outer angular portion.

SUMMARY OF THE INVENTION

This and other objects of the present invention have now been achieved by the discovery of apparatus for refining lignocellulose material which comprises a first stationary refiner disk, a second rotatable refiner disk rotatably mounted adjacent to the first stationary refiner disk on a rotatable shaft whereby a refining gap is created between the first and second refiner disks, the first stationary refiner disk including an inner substantially radial portion and an outer angular portion, and a second rotatable refiner disk including an inner substantially radial portion and an outer angular portion, whereby the refining gap includes an inner radial refining gap portion and an outer angular refining gap portion angularly disposed with respect to the inner radial refining gap portion in the direction facing away from the inner radial refining gap towards the direction of rotation of the refiner shaft, a first refiner element mounted on the outer angular portion of the first refiner disk, and a second refiner element mounted on the outer angular portion of the second refining disk, thereby defining the outer angular refining gap portion therebetween, the second refiner element including at least one wing member projecting from the second refiner element adjacent to the inner radial refining gap, and the first refiner element including an inlet portion juxtaposed with the wing member of the second refiner element, the inner portion including a concave surface, whereby the lignocellulose material is thrown against the concave surface during its transition from the inner radial refining gap portion to the outer angular refining gap portion.

In accordance with one embodiment of the apparatus of the present invention, the wing member includes an outer surface having a curvature with respect to the inner radial refining gap portion. In a preferred embodiment the concave surface of the inlet portion at least partially encloses the wing member, at least a portion of the wing member having a curvature substantially corresponding to the curvature of the concave surface.

In accordance with another embodiment of the apparatus of the present invention, the inlet portion of the first refiner element includes a shoulder defined by the pair of inclined sides.

In accordance with this invention, it has thus been discovered that by forming the cooperating refining elements with wings and concave curved surfaces, respectively, feed from the inner portion of the refining zone to the angular outer portion is ensured. The wings on the rotating refining elements thus project the material to be refined against the concave curved surface of the stationary refining elements so that the material to be refined is caused to change its direction into the angular portion of the refiner gap.

By means of this construction, both the capacity and the load can be substantially increased, thus also reducing the energy consumption during refining by about 5% to 10% with the same pulp quality.

BRIEF DESCRIPTION OF THE DRAWINGS

The present invention may be more fully appreciated with reference to the following detailed description, which, in turn, refers to the Figures of various embodiments of the present invention in which.

DETAILED DESCRIPTION

Figure 1:
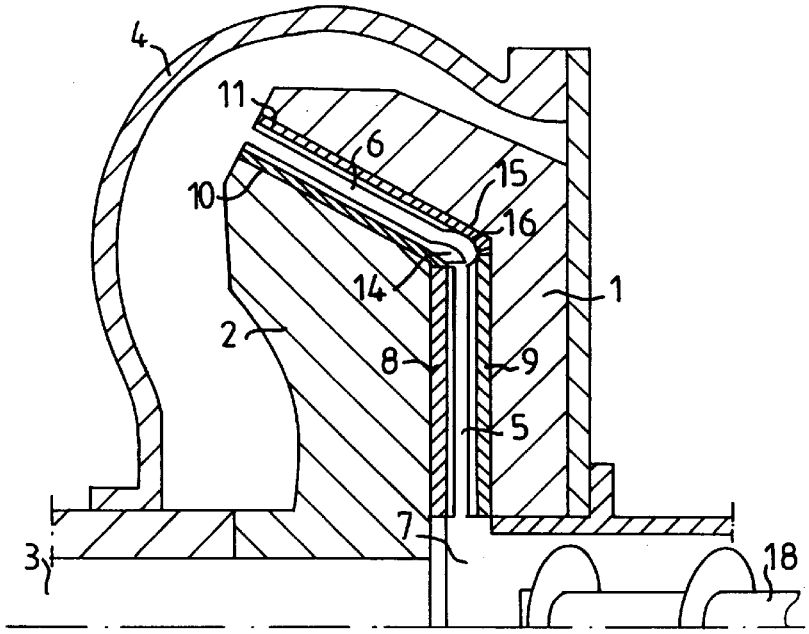
FIG. 1 is a side, elevational, partially sectional, partially schematic representation of a refiner in accordance with the present invention including an inner radial and an outer angular refining gap portion.

Referring to the Figures, in which like reference numerals refer to like elements thereof, the refiner shown in FIG. 1 is formed with a stationary refining disk 1 and a rotary refining disk 2 mounted on a rotary shaft 3. The refiner gap can thus be controlled by axial movement of the shaft 3. The refining disks are enclosed in an airtight refiner housing 4. Between the refining disks a refiner gap is formed, which consists of an inner radial portion 5 and an angular outer portion 6. The angle of inclination to the rotary shaft should be less than about 450, and preferably between about 10 and 30°. The stationary refining disk 1 has a central opening 7, through which the material to be refined is fed.

Each of the refining disks is provided with wear portions in the form of refining elements 8–11 both in the inner radial portion of the refiner gap 5 and in the outer angular portion 6. The refining elements are provided with bars 12 and intermediate grooves 13 for working and refining the material to be refined.

In the outer angular portion 6 of the refiner gap, the stationary refining disk 1 is located outside the rotary refining disk 2. The refining elements, 10 and 11, on these refining discs, 1 and 2, are thus located outside the outer angular portion of the refiner gap.

The refining element 10, located on the inside, is provided with at least one freely projecting wing 14 extending in the direction facing the inner radial portion 5 of the refiner gap. Each wing 14 is preferably formed as an extension of one of the bars 12 on the refining element 10. The bars 12 can also be angular in relation to the radius, in order to increase the pumping effect. The wing, like the bars, is widest at the base and tapers upwardly. The wing can also be curved towards the inner portion 5 of the refiner gap. According to the embodiment shown, the refining element 10 is provided with two wings 14. The refining element 11 located on the outside is provided with an inlet portion 15 located directly in front of the wings 14 and provided with a concavely curved surface 16. The inlet portion 15 can be curved towards the inner portion 5 of the refiner gap, so that it partially encloses the wings 14. The upper edge of the wings 14 can have a curvature, which substantially corresponds to the curvature of the inlet portion 15, ash shown in FIG. 2.

In view of the wings 14 and the rotation of the refining disk 2, the wings 14 on the refining element 10 located on the inside throw the material to be refined obliquely outwardly towards the inlet portion 15 on the refining element 11 located on the outside. When the material to be refined meets the concavely curved surface 16, the direction of movement of the material to be refined is changed into the outer angular portion 6 of the refiner gap.

Figure 2:
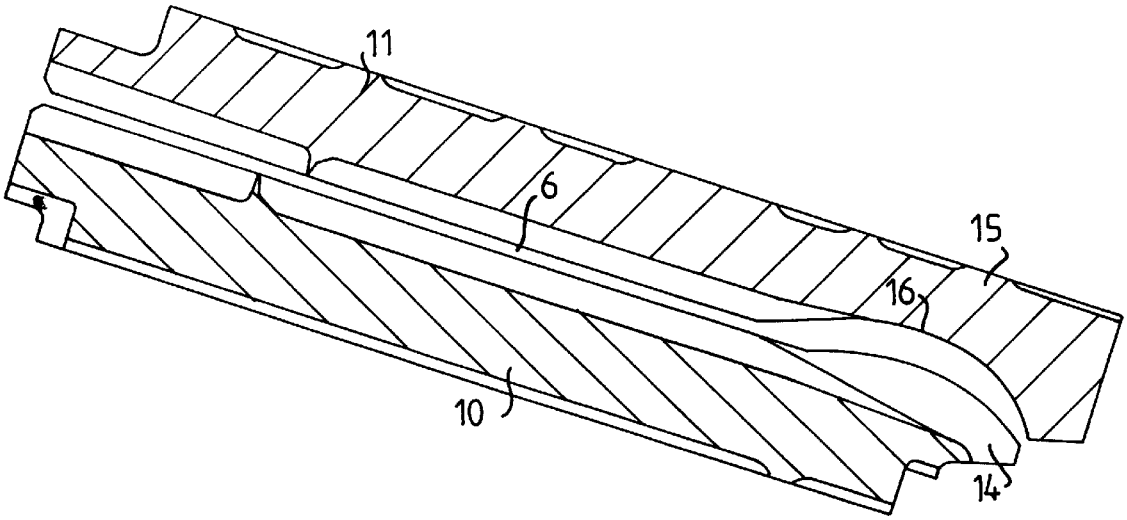
FIG. 2 is a side, elevational, sectional, enlarged view of two cooperating refiner elements in the outer portion of the refiner of the present invention.
Figure 3:
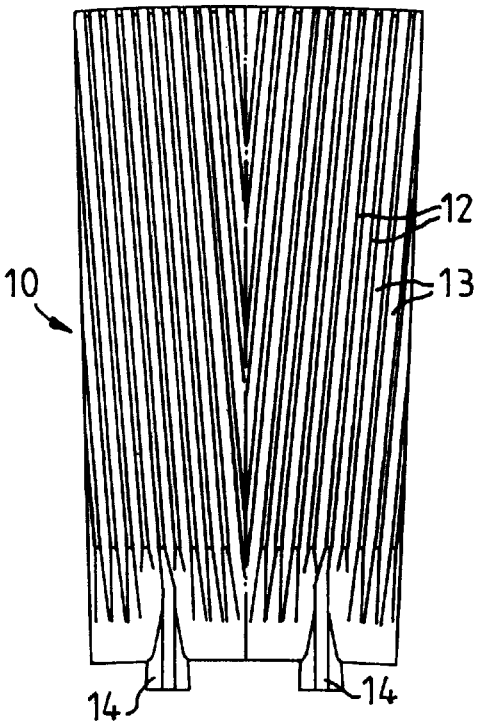
FIG. 3 is a top, elevational view of a refining element for the rotary refining disk of the present invention located inside the angular portion of the refining gap.
Figure 4:
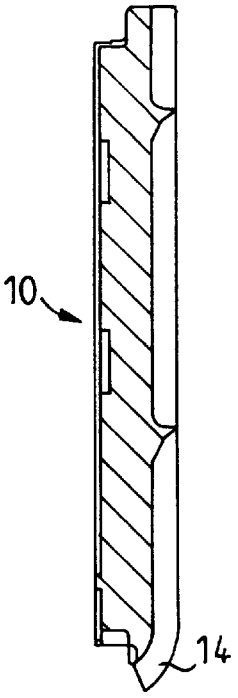
FIG. 4 is a side, elevational, sectional view of the refining element shown in FIG. 3.
Figure 5:
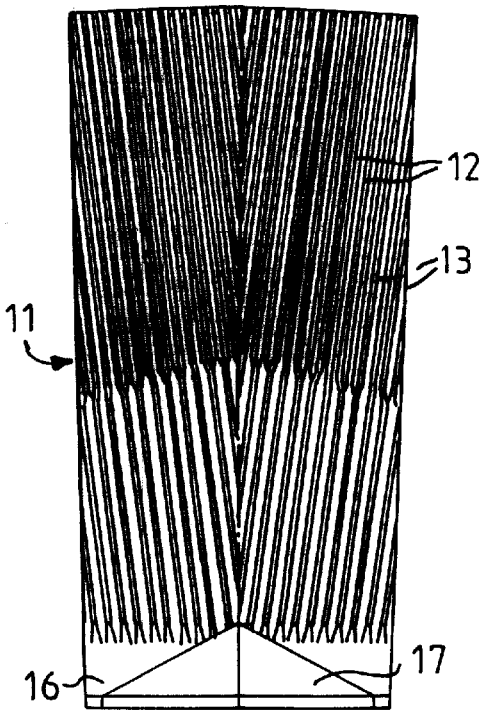
FIG. 5 is a top, elevational view of a refining element with a stationary refining disk of the present invention located outside the angular portion of the refining gap.
Figure 6:
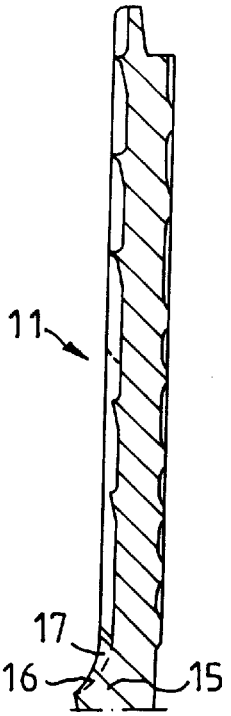
FIG. 6 is side, elevational, sectional view of the refining element shown in FIG. 5.

According to the embodiments of the two co-operating refining elements shown in FIGS. 3–6, the refining element 10 located on the inside is formed with projecting wings 14, as in the embodiment according to FIGS. 1 and 2. The refining element 1:L located on the outside, however, has been completed with a shoulder 17 in the concavely curved surface 16 in the inlet portion 15. The shoulder 17 preferably has a substantially triangular cross-section. The inclined flanks on the shoulder 17 are intended to additionally improve the feed of the material to be refined into the outer angular portion 6 of the refiner gap.

The material to be refined is fed into the central feed zone between the refining disks through the opening 7 in the stationary refining disk 1 by means of a feed screw 18 coaxial with the shaft 3. The material to be refined is thereby caused to move outwardly through the inner radial portion 5 of the refiner gap while simultaneously being worked by the radial refining elements, 8 and 9. The feed from the inner radial portion 5 of the refiner gap to the outer angular portion 6 is promoted by the wings 14 and opposite inlet portion 15. It has thus been found that both the capacity and load can be increased considerably, e.g., by about 20%, by using these types of refining elements, compared with conventional ones. It has also been found that it is possible to reduce the specific energy consumption by about 5–10%. It should further be noted that these improvements were achieved while maintaining the pulp quality.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. Apparatus for refining lignocellulose material comprising a first stationary refiner disk, a second rotatable refiner disk rotatably mounted adjacent to said first stationary refiner disk on a rotatable shaft whereby a refining gap is created between said first and second refiner disks, said first stationary refiner disk including an inner substantially radial portion and an outer angular portion, and said second rotatable refiner disk includes an inner substantially radial portion and an outer angular portion, whereby said refining gap includes an inner radial refining gap portion and an outer angular refining gap portion angularly disposed with respect to said inner radial refining gap portion in a direction facing away from said inner radial refining gap towards the direction of rotation of said refiner shaft, a first refiner element mounted on said outer angular portion of said first refiner disk, and a second refiner element mounted on said outer angular portion of said second refiner disk, thereby defining said outer angular refining gap portion therebetween, said second refiner element including at least one wing member projecting from said second refiner element adjacent to said inner radial refining gap, and said first refiner element including an inlet portion juxtaposed with said wing member of said second refiner element, said inlet portion including a concave surface, whereby said lignocellulose material is thrown against said concave surface during its transition from said inner radial refining gap portion to said outer angular refining gap portion.

2. The apparatus of claim 1 wherein said wing member includes an outer surface having a curvature with respect to said inner radial refining gap portion.

3. The apparatus of claim 2 wherein said concave surface of said inlet portion at least partially encloses said wing member, at least a portion of said wing member having a curvature substantially corresponding to the curvature of said concave surface.

4. The apparatus of claim 1 wherein said inlet portion of said first refiner element includes a shoulder defined by a pair of inclined sides.

* * * * *

UNITED STATES PATENT AND TRADEMARK OFFICE

CERTIFICATE OF CORRECTION

PATENT NO. : 5,950,946
DATED : September 14, 1999
INVENTOR(S) : Kjellqvist et al.

It is certified that error appears in the above-identified patent and that said Letters Patent is hereby corrected as shown below:

Title page,
Item [54], "DISC" should read -- "DISK" --.

Column 1,
Line 2, "DISC" should read -- "DISK" --.

Column 3,
Line 5, delete "450" and insert therefor -- 45° --.
Line 50, delete "1:L" and insert therefor -- 11 --.

Signed and Sealed this

Fifth Day of February, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 5,950,946
APPLICATION NO. : 09/051873
DATED : September 14, 1999
INVENTOR(S) : Kjellqvist et al.

It is certified that error appears in the above-identified patent and that said Letters Patent is hereby corrected as shown below:

Column 1, line 63 change "direction" to --axis--
Claim 1, change the second occurrence of the word "direction" to --axis--

Signed and Sealed this

Eighth Day of September, 2009

David J. Kappos

David J. Kappos
*Director of the United States Patent and Trademark Office*

UNITED STATES PATENT AND TRADEMARK OFFICE

CERTIFICATE OF CORRECTION

PATENT NO. : 5,950,946
APPLICATION NO. : 09/051873
DATED : September 14, 1999
INVENTOR(S) : Kjellqvist et al.

It is certified that error appears in the above-identified patent and that said Letters Patent is hereby corrected as shown below:

Column 1, line 63 change "direction" to --axis--
Column 4, Claim 1, lines 34-35, change the second occurrence of the word "direction" to --axis--

This certificate supersedes the Certificate of Correction issued September 8, 2009.

Signed and Sealed this

Sixth Day of October, 2009

David J. Kappos

David J. Kappos
*Director of the United States Patent and Trademark Office*